US011562723B2

(12) United States Patent
Sakata

(10) Patent No.: US 11,562,723 B2
(45) Date of Patent: Jan. 24, 2023

(54) ELECTRONIC MUSICAL INSTRUMENT, METHOD OF GENERATING MUSICAL SOUND, AND STORAGE MEDIUM

(71) Applicant: CASIO COMPUTER CO., LTD., Tokyo (JP)

(72) Inventor: Goro Sakata, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 205 days.

(21) Appl. No.: 17/020,958

(22) Filed: Sep. 15, 2020

(65) Prior Publication Data

US 2021/0090539 A1 Mar. 25, 2021

(30) Foreign Application Priority Data

Sep. 24, 2019 (JP) ..... JP2019-172949

(51) Int. Cl.
*G10H 1/055* (2006.01)
*G10H 1/12* (2006.01)
(Continued)

(52) U.S. Cl.
CPC ..... *G10H 1/055* (2013.01); *G10H 1/125* (2013.01); *G10H 5/007* (2013.01); *G10H 7/06* (2013.01);
(Continued)

(58) Field of Classification Search
CPC ..... G10H 1/055
(Continued)

(56) References Cited

U.S. PATENT DOCUMENTS 5,187,314 A * 2/1993 Kunimoto ..... G10H 5/007 84/630
5,587,548 A * 12/1996 Smith, III ..... G10H 5/007 84/622
(Continued)

FOREIGN PATENT DOCUMENTS

EP 3882906 A1 * 9/2021 ..... G10H 1/0091
JP H09222890 A * 2/1997
(Continued)

OTHER PUBLICATIONS

Extended European Search Report dated Mar. 10, 2021 received in European Patent Application No. EP 20195432.8.
(Continued)

*Primary Examiner* — Christina M Schreiber
(74) *Attorney, Agent, or Firm* — Scully Scott Murphy & Presser

(57) ABSTRACT

According to one aspect, there is an electronic musical instrument including operators which includes a first operator corresponding to a first pitch and a second operator corresponding to a second pitch, and a sound source configured to generate a first output signal from a first close loop and a second output signal from a second close loop, to generate an integration signal, and return a subtraction signal, the subtraction signal being obtained by subtracting a signal circulating through the first close loop from the integration signal, to the first close loop, and then output a musical sound signal including signal components corresponding to the second pitch as a musical sound signal corresponding to the first pitch.

13 Claims, 10 Drawing Sheets

(51) Int. Cl.
*G10H 5/00* (2006.01)
*G10H 7/06* (2006.01)

(52) U.S. Cl.
CPC . *G10H 2210/271* (2013.01); *G10H 2250/515* (2013.01); *G10H 2250/521* (2013.01)

(58) Field of Classification Search
USPC ..... 84/630
See application file for complete search history.

(56) References Cited

U.S. PATENT DOCUMENTS

| | | | | | |
|---|---|---|---|---|---|
| 5,777,249 | A * | 7/1998 | Suzuki | G10H 7/00 | 84/622 |
| 6,284,965 | B1 * | 9/2001 | Smith, III | G10H 1/125 | 84/622 |
| 9,478,203 | B2 | 10/2016 | Nakata | | |
| 10,818,278 | B2 * | 10/2020 | Liu | G10H 1/0091 | |
| 11,094,307 | B2 * | 8/2021 | Sakata | G10H 1/12 | |
| 2012/0240750 | A1 * | 9/2012 | Kakishita | G10H 5/007 | 84/604 |
| 2015/0221296 | A1 * | 8/2015 | Nakata | G10H 1/08 | 84/725 |
| 2019/0341012 | A1 * | 11/2019 | Liu | G10H 1/08 | |
| 2020/0111463 | A1 * | 4/2020 | Sakata | G10H 5/007 | |
| 2021/0090539 | A1 * | 3/2021 | Sakata | G10H 1/055 | |

FOREIGN PATENT DOCUMENTS

| | | | | | |
|---|---|---|---|---|---|
| JP | H09-222890 | A | | 8/1997 | |
| JP | H09222890 | A | * | 8/1997 | |
| JP | H10-63270 | A | | 3/1998 | |
| JP | 2012-203145 | A | | 10/2012 | |
| JP | 2012203145 | A | * | 10/2012 | G10H 5/007 |
| JP | 2015-143764 | A | | 8/2015 | |
| JP | 2020-056976 | A | | 4/2020 | |
| JP | 2020-056977 | A | | 4/2020 | |
| WO | 2018/135403 | A1 | | 7/2018 | |
| WO | WO-2018135403 | A1 | * | 7/2018 | G10H 1/08 |

OTHER PUBLICATIONS

Notice of Reasons for Refusal dated May 24, 2022 received in Japanese Patent Application No. JP 2019-172949.

* cited by examiner

| Relative key positions producing resonance [half step] | Relative tone interval to be pronounced [half step] |
|---|---|
| +24+7 | +24+7 |
| +24+4 | +24+4 |
| +24 | +24 |
| +12+7 | +12+7 |
| +12 | +12 |
| +7 | +12+7 |
| +5 | +24 |
| 0 (Original pitch) | — |
| −5 | +12+7 |
| −7 | +12 |
| −12 | 0 |
| −12−4 | +12 |
| −12−5 | +12+7 |

FIG. 1

ELECTRONIC MUSICAL INSTRUMENT, METHOD OF GENERATING MUSICAL SOUND, AND STORAGE MEDIUM

CROSS-REFERENCE TO RELATED APPLICATIONS

This application is based upon and claims the benefit of priority from Japanese Patent Application No. 2019-172949, filed Sep. 24, 2019, the entire contents of which are incorporated herein by reference.

BACKGROUND OF THE INVENTION

1. Field of the Invention

The present invention relates to an electronic musical instrument, a method of generating musical sound, and a storage medium.

2. Description of the Related Art

For example, Jpn. Pat. Appln. KOKAI Publication No. 2015-143764 provides a technique for a resonance sound generating apparatus that can imitate resonance sound of an acoustic piano more faithfully.

According to the technique described in Jpn. Pat. Appln. KOKAI Publication No. 2015-143764, resonators comparable to string models are connected in a feedforward manner (a manner that connects the resonator to the subsequent step of outputs of the models), so that actual, physical resonance can be produced stably. However, at the same time, providing the string models as well as the resonators significantly increases a circuit size, which is problematic.

SUMMARY OF THE INVENTION

According to one aspect of the present invention, there is provided an electronic musical instrument comprising: a plurality of operators which includes a first operator corresponding to a first pitch and a second operator corresponding to a second pitch; and a sound source, wherein the sound source is configured to: generate, in response to designation of the first operator and the second operator, a first output signal from a first close loop corresponding to the first pitch, and a second output signal from a second close loop corresponding to the second pitch, generate an integration signal by integrating the first output signal and the second output signal, and return a subtraction signal, the subtraction signal being obtained by subtracting a signal circulating through the first close loop from the integration signal, to the first close loop, and then output a musical sound signal including signal components corresponding to the second pitch as a musical sound signal corresponding to the first pitch.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 1 is a diagram showing the relationship between relative tone intervals to be pronounced as resonance sound corresponding to relative key positions that produce resonance, according to an embodiment of the present invention;

DETAILED DESCRIPTION OF THE INVENTION

Figure 2:
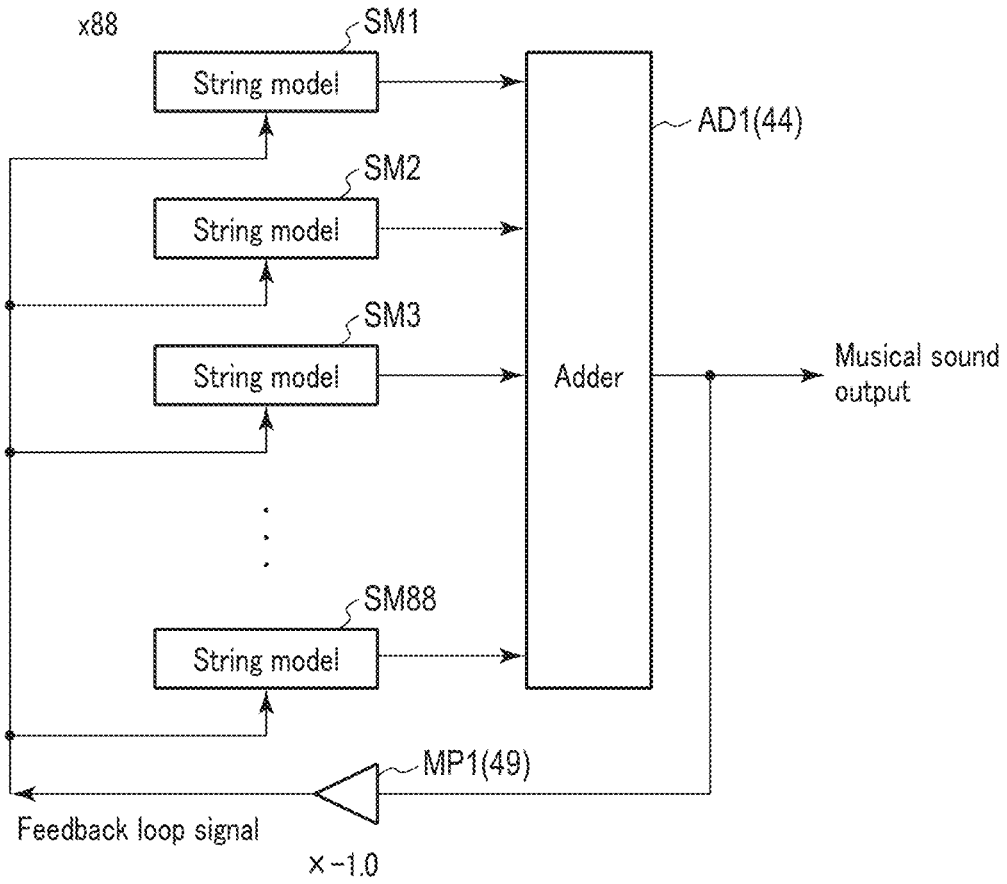
FIG. 2 is a diagram illustrating the overall system according to the embodiment in a simplified manner.

Hereinafter, an embodiment in the case where the present invention is applied to an electronic keyboard musical instrument will be described with reference to drawings.

Basic Concept of the Present Embodiment

Before describing specific configuration and operation of an embodiment in the case where the present invention is applied to an electronic musical instrument, a basic outline of the present embodiment will be described.

There is also a method for generating resonance sound by calculating beforehand the resonance sound that should be generated, from the relationship between notes. For example, in the case where sounds having pitches A4 (440 Hz) and A5 (880 Hz) are pronounced simultaneously by being superposed, the second harmonic of A4 (880 Hz) and the fundamental tone of A5 (880 Hz) are the same frequency, so that resonance sound of A5 (880 Hz) is generated. In this case, a relative difference in pitch is 12 half steps.

FIG. 1 is a diagram showing the relationship between relative tone intervals (in units of half steps) to be pronounced as resonance sound corresponding to relative key positions that produce resonance (in units of half steps). In FIG. 1, when a relative key position "+12" is searched for, a relative tone interval "+12" to be pronounced is obtained. That is, when a pitch is set as a reference, resonance sound can be generated by storing a relative pitch difference between two sounds and relative resonance tone intervals to be pronounced in a look-up table or the like; for example, add 12 half steps to A4 to obtain A5, or resonance sound can be generated based on data that indicates a pitch of which resonance sound is generated and obtained by calculating the common multiple of basic sound frequencies of two pitches every time.

In the case where such a method is adopted, there is no special resonator, resonance does not actually occur, and thus anomalous oscillation does not occur, either. However, although pronouncing a single resonance sound will suffice to pronounce two sounds, pronouncing three sounds requires consideration of three resonance relationships in three combinations of sounds, and thus the number of resonance sounds is three. That is, the number of combinations of resonance sounds that should be generated sharply increases with an increase in the number of sounds to be pronounced. In other words, it is necessary to provide pronunciation channels for pronouncing the resonance sounds. Accordingly, if a limitation is imposed on the number of resonance sounds allowed to be generated, the limitation results in a disadvantage that not all of resonance sounds to be generated cannot be generated. In addition, if all of the combinations are calculated with a processor, a load on software increases.

Hence, the present embodiment implements resonance sounds given by a string resonance effect of a plurality of string models without adding many computational resources. That is, the present embodiment makes it difficult to bring about anomalous oscillation by, in response to key-pressing performed on a plurality of keys, integrating outputs from the plurality of string models to produce integration data on an all-string model, subtracting from the integration data on the all-string model output data from a self-string model to produce integration data on an other-strings model, from which the self-string model is excluded, and returning and inputting the integration data on the other-strings model back into the self-string model as feedback.

FIG. 2 is a diagram illustrating a string model system according to the present embodiment in a simplified manner. For example, in the case of a piano electronic musical instrument including string models SM1 to SM88 for 88 keys at maximum, output signals from the string models are integrated by an adder AD1, and the integration output is output as a musical sound signal. At the same time, a polarity (phase) of the integration output is inverted (multiplied by −1) by an inverting amplifier MP1, and the output with the inverted polarity is returned and input back into the string models SM1 to SM88 as a feedback loop signal.

For example, in response to designation of a first operator and a second operator, a first output signal from a first close loop (36A to 40A) corresponding to a first pitch (SM1) and a second output signal from a second close loop corresponding to a second pitch (SM2) are generated (44), and an integration signal is generated by integrating the first output signal and the second output signal.

Then, a subtraction signal, the subtraction signal being obtained by subtracting (46A) a signal circulating through the first close loop (36A to 40A) from the integration signal, is returned to the first close loop (41A), and then a musical sound signal including signal components corresponding to the second pitch is output as a musical sound signal corresponding to the first pitch.

That is, each of the string models SM1 to SM88 subtracts content output by the self-string model from the feedback loop signal, and then adds a signal as the difference to a loop circuit in the model, thereby generating a musical sound with resonance sound.

This feedback process is to be performed on a close loop corresponding to a pitch that is being pronounced. This feedback process does not need to be performed on a close loop corresponding to a pitch that is not being pronounced.

As shown in FIG. 2, the negative feedback configuration in which the polarity (phase) of the integration output is inverted (x−1) by the inverting amplifier MP1 lowers a feedback value of the string itself by a reduction amount of a negative feedback coefficient, so that stability can be increased.

That is, in order to generate the integration signal, the sound source (12D) inverts (49) the polarity of a signal resulting from the integration (44) of the first output signal from the first close loop (36A to 40A) and the second output signal from the second close loop.

The increase in stability can in turn allows setting an upper limit of a resonance value to a higher value, so that more considerable string resonance effect can be obtained.

In this connection, the negative feedback configuration lowers the feedback value of the string itself by the reduction amount of the negative feedback coefficient, that is, lowers a feedback ratio of each string, thereby lowering a gain. The string models are each a delayed positive feedback loop. Therefore, the strings have the same DC gain while having different pitches. Lowering of the DC gain of each string means that residues attributable to a high gain can be reduced.

Specifically, in response to designation of the first operator and the second operator, the sound source (12D) adds, to the first close loop (36A to 40A) through which an excitation signal corresponding to the first pitch is circulated, a signal based on the second output signal from the second close loop through which an excitation signal corresponding to the second pitch is circulated, to generate a musical sound signal corresponding to the first pitch and including a signal component corresponding to the second pitch, and adds, to the second close loop, a signal based on the first output signal from the first close loop (36A to 40A), to generate a musical sound signal corresponding to the second pitch and including a signal component corresponding to the first pitch.

Figure 4:
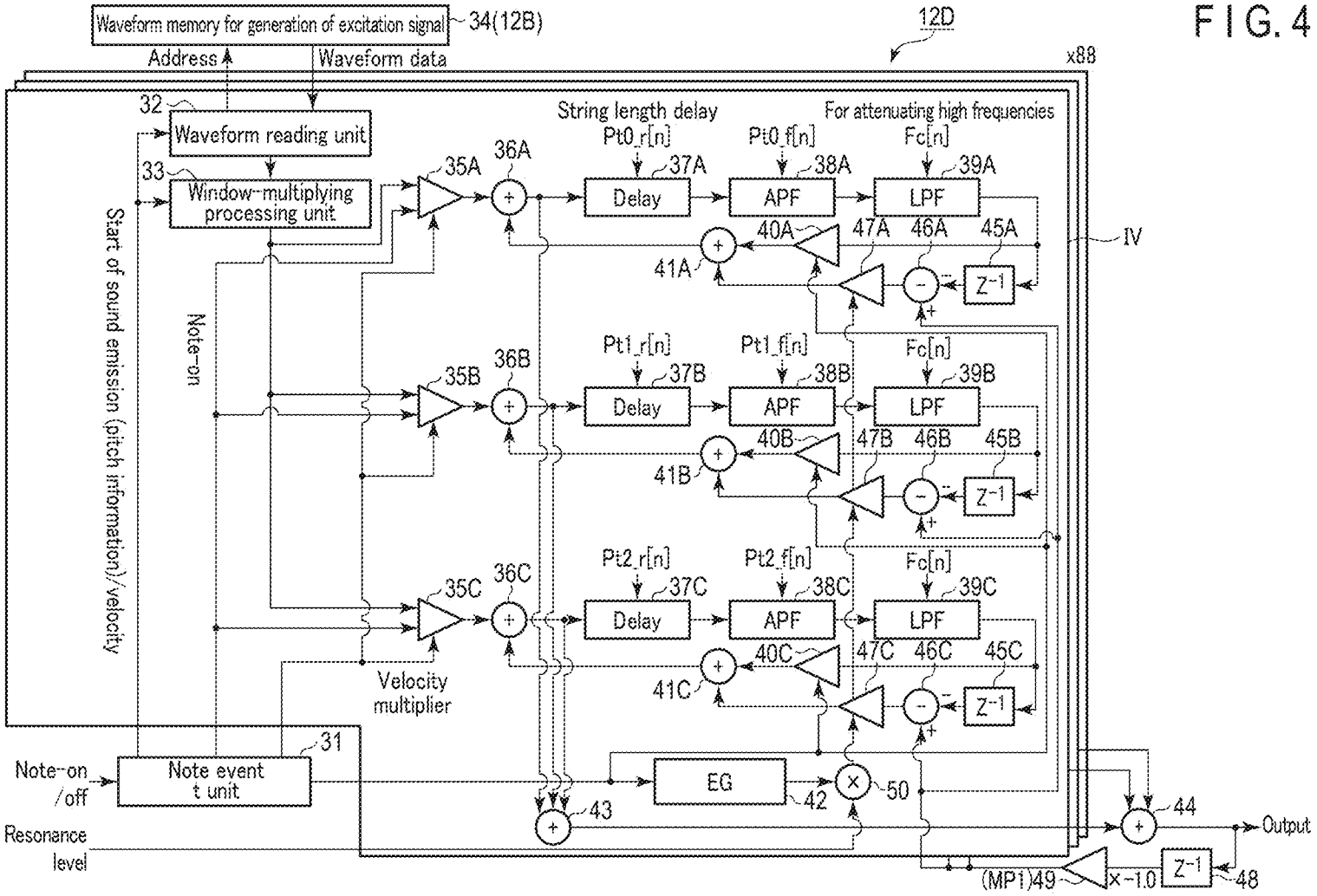
FIG. 4 is a block diagram showing functions implemented by a DSP of a sound source according to the embodiment as a hardware configuration.
Figure 10:
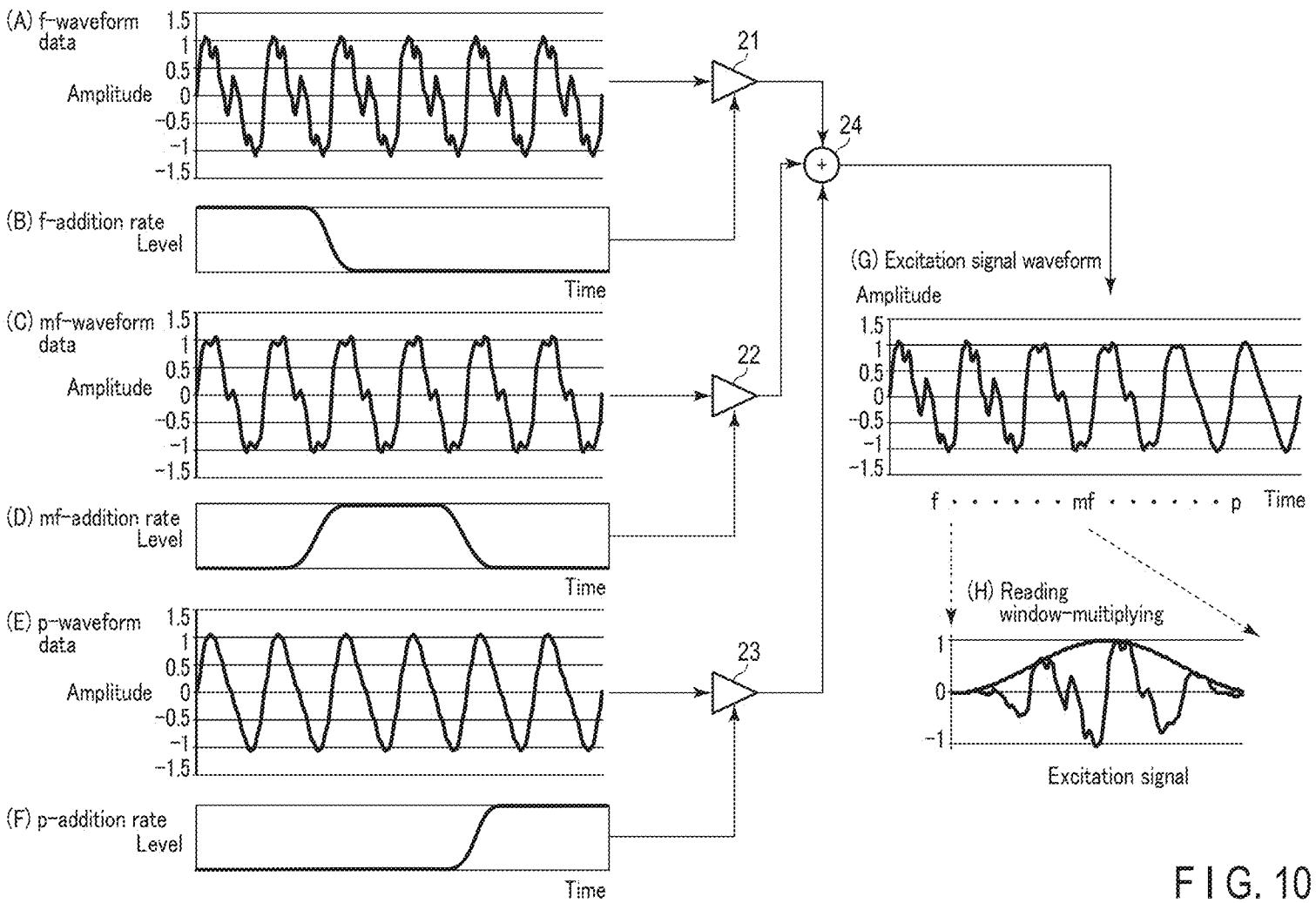
FIG. 10 is a diagram illustrating a method of generating excitation signals from an addition synthesis of strength waveforms, according to the embodiment.

Here, the excitation signals are each generated by, for a corresponding pitch, a window-multiplying processing unit multiplying (33) partial data contained in the excitation signal waveform data (G), which is generated based on a plurality of waveform data items (A, C, E) having sound intensities different from one another as shown in FIG. 10, by a window function, as shown in FIG. 4.

[Configuration]

Figure 3:
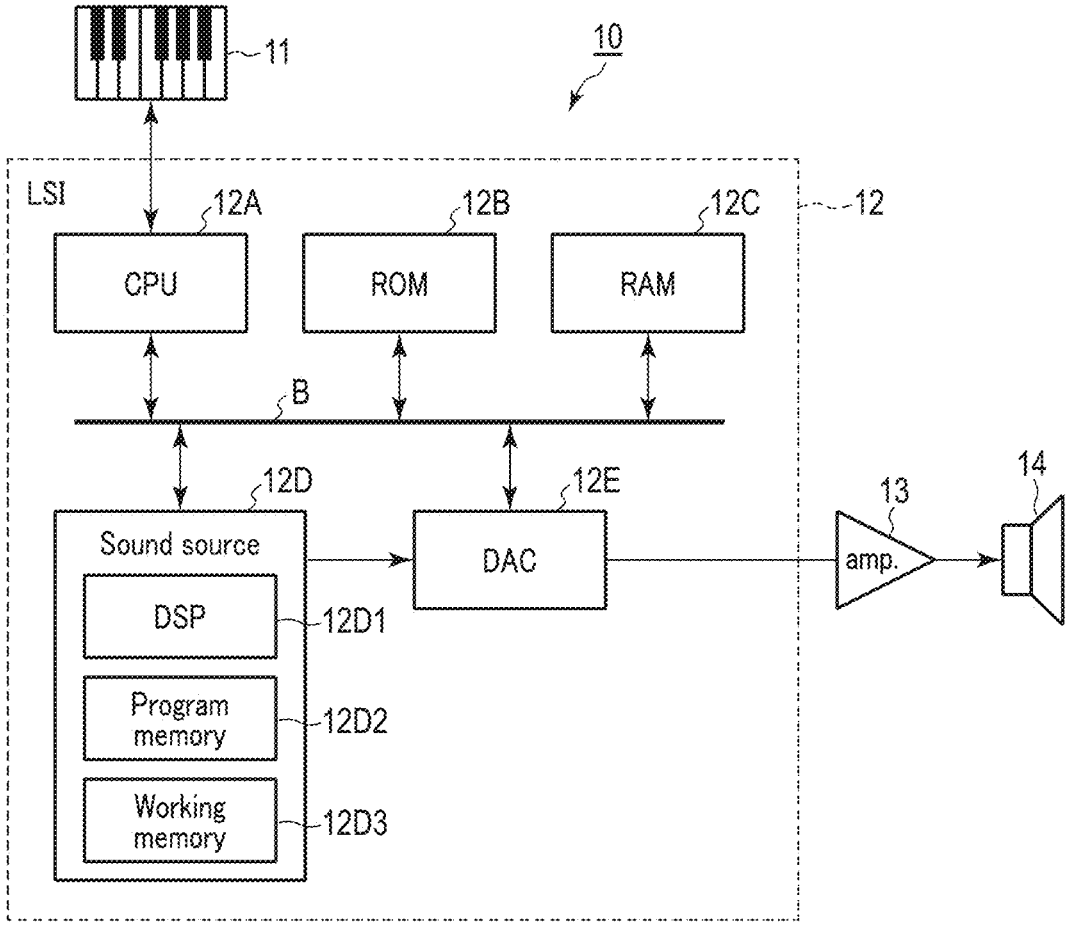
FIG. 3 is a block diagram showing the configuration of a basic hardware circuit of an electronic keyboard musical instrument according to the embodiment.

FIG. 3 is a block diagram showing the configuration of a basic hardware circuit in the case where the embodiment is applied to an electronic keyboard musical instrument 10. In the same figure, an operation signal including a note number (pitch data) and a velocity value (key-pressing speed) as sound volume data, which is generated according to the operation at a keyboard 11 having playing operators (keys), is input in CPU12A of LSI12.

LSI12 connects, via a bus B, CPU12A, ROM12B, RAM12C, a sound source 12D, and a D/A converting unit (DAC) 12E.

The CPU 12A controls overall operations of the electronic keyboard musical instrument 10. The ROM12B stores excitation signal waveform data, etc. for operation programs or playing (music performance) performed by the CPU12A. The RAM 12C is a working memory used by the CPU 12A when the CPU 12A reads, expands, and stores an operation program stored in the ROM 12B onto the RAM 12C, and performs the program. The CPU12A gives a parameter, such as a note number and a velocity value, to the sound source 12D during the playing operation.

The sound source 12D comprises a digital signal processor (DSP) 12D1, a program memory 12D2, and a working memory 12D3. The sound source 12D causes the DSP 12D1 to read the operation program and fixed data stored in the program memory 12D2, expand and store the operation program and the fixed data onto the working memory 12D3, and then perform the operation program, thus, in response to the parameter given from the CPU 12A, reading partial data based on necessary excitation signal waveform data from the ROM 12B, generating a musical sound signal through signaling processing, and outputting the generated musical sound signal to the D/A converting unit 12E.

The D/A converting unit 12E analogizes the musical sound signal and outputs it to an amplifier (amp.) 13. A speaker 14 speech-amplifies and emits musical sound by means of the analogue musical sound signal amplified by the amplifier 13.

FIG. 4 is a block diagram showing functions implemented primarily by the sound source 12D as a hardware configuration. In FIG. 4, the range shown by IV, excluding a note event processing unit 31, a waveform memory 34, an adder 44, a delay retainer 48, a reversal amplifier 49 (to be described later), corresponds to a single key included in the keyboard. In this electronic keyboard musical instrument 10, circuits for 88 keys (each the same as the circuit described above) are provided, based on the assumption that there are 88 keys in the keyboard 11.

Also, the electronic keyboard musical instrument 10 includes a signal circulation circuit of a string model with one string per key (lowest register), two strings per key (lower register), or three strings per key (medium or higher register). In FIG. 4, a circuit IV for a key having a signal circulation circuit of a model of three strings is extracted and illustrated.

A note on/off signal according to an operation of a key at the keyboard 11 is input from the CPU12A to the note event processing unit 31.

In response to the key operated, with consideration given to relative tone intervals to be pronounced as resonance sounds shown in FIG. 1, the note event processing unit 31 sends respective pieces of information on a note number and a velocity value, at the point of the start of sound emission (note-on), to a waveform reading unit 32 and a window-multiplying processing unit 33, and sends a multiplier according to the note-on signal and velocity value to gate amplifiers 35A to 35C in each of the string models.

Furthermore, the note event processing unit 31 sends a signal indicating a feedback attenuation amount to an envelope generator (EG) 42 and attenuation amplifiers 40A to 40C.

The waveform reading unit 32 generates a reading address according to information on the note number and velocity value, and reads waveform data as an excitation signal from the waveform memory 34.

Figure 5:
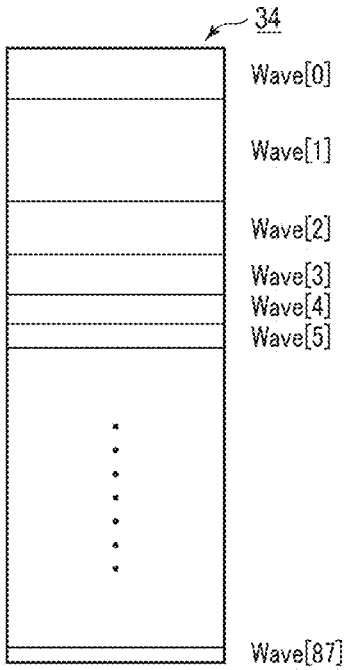
FIG. 5 is a diagram illustrating excitation signal waveform data for 88 keys to be stored in a waveform memory according to the embodiment.

FIG. 5 illustrates waveform data for 88 keys stored in the waveform memory 34. Wave (0) is waveform data of the lowest sound, and Wave (87) is waveform data of the highest sound. When storing waveform data for only the same wavelength, waveform data corresponding to a lower note number has longer waveform data than waveform data corresponding to a higher note number, and has a larger occupied area in the memory, since lower sound has a longer wavelength.

An address value, to which a value offset in each Wave (n) is added according to a velocity value of sound emission, is given in accordance with a pitch of sound pronunciation as an offset address to any one of the leading addresses in the excitation signal waveform data of 88 sounds.

The waveform reading unit 32 outputs partial data read out from the waveform memory 34 to the window-multiplying processing unit 33.

The window-multiplying processing unit 33 performs window-multiplying (window function) processing in a time width corresponding to a wavelength of the pitch according to the note number from the note number information, and sends the window-multiplying processed waveform to the gate amplifiers 35A to 35C.

Hereinafter, the subsequent step of one of the signal circulation circuits of the model with three strings, e.g., the gate amplifier 35A of the highest step side, is cited and explained as an example.

In the gate amplifier 35A, the window-multiplying processed waveform data is subjected to amplification processing using a multiplier according to a velocity value, and the processed waveform data is output to an adder 36A. Waveform data on which resonance sounds are superimposed, output by an adder 41A to be described later, has been returned to, and also input in, the adder 36A, and the addition output is output to a delay circuit 37A and an adder 43 as the output of this string model.

In the delay circuit 37A of the acoustic piano, a string length delay Pt0_*r* [n] has been set as a value according to an integer part of a single wavelength of sound output when the string vibrates (e.g., an integer "20" when the sound corresponds to a high note key; and an integer "2000" when the sound corresponds to a low note key), and the delay circuit 37A delays the waveform data by only the string length delay Pt0_*f* [n] and outputs the waveform data to an all-pass filter (APF) 38A in the subsequent step.

In the all-pass filter 38A, a string length delay Pt0_*f* [n] has been set as a value according to a decimal part of the single wavelength, and the all-pass filter 38A delays the waveform data by only the string length delay Pt0_*f* [n] and outputs the waveform data to a low-pass filter (LPF) 39A in the subsequent step. That is, the waveform data is delayed, by the delay circuit 37A (to 37C) and the all-pass filter 38A (to 38C), for the time determined in accordance with the input note number information (pitch data) (the time for a single wavelength).

The low-pass filter 39A passes the waveform data on the low-frequency side by using a cut-off frequency Fc [n] for high-frequency band attenuation set for the frequency of the string length, and outputs the waveform data to an attenuation amplifier 40A and a delay retainer 45A.

The attenuation amplifier 40A performs normal attenuation processing irrelevant to superimposition of resonance sound, and outputs the attenuated waveform data to the adder 41A.

The delay retainer 45A retains the waveform data output by the low-pass filter 39A by only a sampling cycle (Z−1) and then outputs it to a subtractor 46A as a subtrahend.

Waveform data of resonance sound a sampling cycle earlier, on which the all-string model is superimposed, is also input to the subtractor 46A from the reversal amplifier 49 to be described later, from which waveform data of the self-string model as output of the low-pass filter 39A is subtracted as a subtrahend, and waveform data of the difference is output to an attenuation amplifier 47A.

Here, using a signal indicating a feedback attenuation amount from a note event processing unit 31, the envelope generator 42 sends a signal indicating a sound volume according to stages of ADSR (Attack/Decay/Sustain/Release) that changes with time, to a multiplying device 50. The multiplying device 50 multiplies this signal by a signal of a resonance level, and outputs the product as a signal indicating a resonance value to the attenuation amplifier 47A (to 47C).

The attenuation amplifier 47A performs attenuation processing at an attenuation rate according to the resonance value input from the multiplying device 50, and outputs the attenuated waveform data to the adder 41A.

The adder 41A adds the waveform data in the self-string model, output by the attenuation amplifier 40A, to the waveform data of the resonance sound on which the other-strings model from which only the self-string model is subtracted, output by the attenuation amplifier 47A, is superimposed and waveform data as the sum is given to the adder 36A as a feedback input.

As described above, the addition output from the adder 36A is output as the output of this string model, to the delay circuit 37A in the same loop circuit and further output to the adder 43.

The adder 43 performs addition processing of the waveform data output by the adder 36A and adders 36B and 36C of the other two lines similarly constituting the circulation circuit for excitation signals, and outputs the sum as a musical sound signal according to the operation of the key to the adder 44.

The adder 44 adds a musical sound signal corresponding to each pressed key, and outputs the sum to the D/A converting unit 12E in the subsequent step for generating a musical sound, and meanwhile outputs it as waveform data of resonance sound before processing to the delay retainer 48.

The delay retainer 48 retains the waveform data output by the adder 44 by only a sampling cycle (Z−1) and then outputs it to the subtractors 46A to 46C of the circuit for each key.

Figure 6:
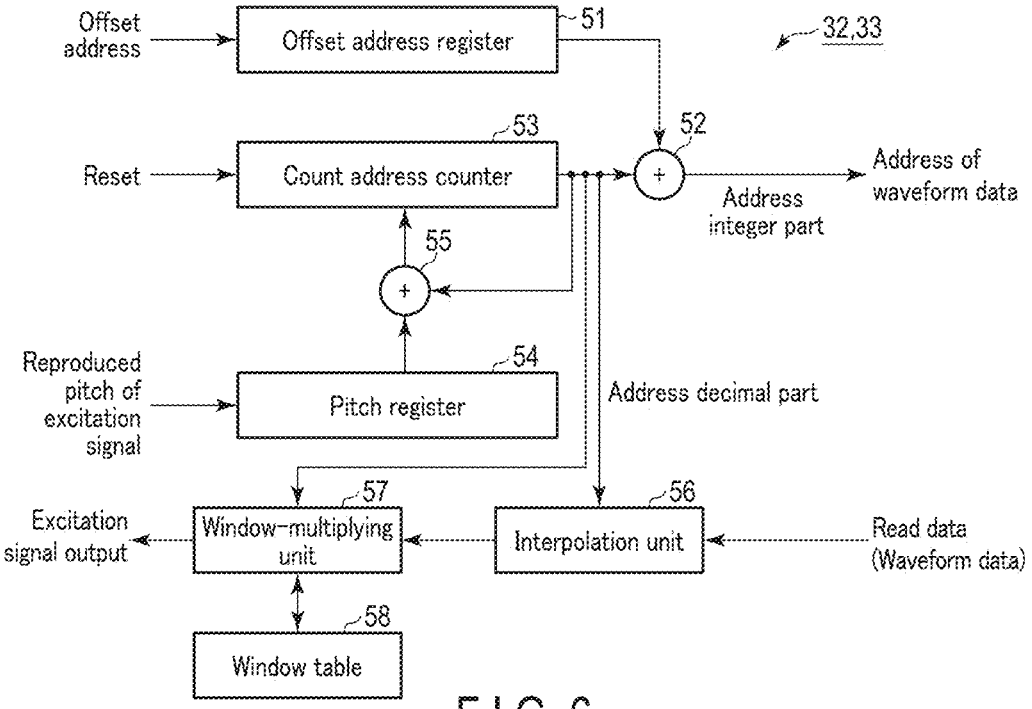
FIG. 6 is a block diagram showing the circuit configuration of a waveform reading unit and a window-multiplying processing unit, according to the embodiment.

FIG. 6 is a block diagram showing the circuit configuration of the waveform reading unit 32 and the window-multiplying processing unit 33.

When a key in the keyboard 11 is pressed, an offset address indicating a leading address according to a note number that should be pronounced, and a velocity value are retained in an offset address register 51. The retained content of the offset address register 51 is output to an adder 52.

Meanwhile, a count value of a current address counter 53 which is reset at the beginning of sound emission to become "0 (zero)" is output to the adder 52, an interpolation unit 56, an adder 55, and a window-multiplying unit 57.

The current address counter 53 is a counter which sequentially increases a count value based on a result obtained by adding, via the adder 55, a retained value at a pitch register 54 which retains a reproduced pitch of an excitation signal and the count value itself.

In the normal case, when a sampling rate of waveform data in the waveform memory 34 agrees with its string model, a reproduced pitch, which is a set value of the pitch register 54, becomes "1.0"; however, when the pitch is changed by master tuning, stretch tuning, rhythm, or the like, a value added to or subtracted from "1.0" is given as the reproduced pitch.

The output (address integer part) of the adder 52, which adds an offset address to a current address, is output as a read-out address to the waveform memory 34, and corresponding waveform data is read out from the waveform memory 34.

The read-out waveform data is, in the interpolation unit 56, subjected to interpolation processing in accordance with an address decimal part according to the pitch output by the current address counter 53, and then output to the window-multiplying unit 57. The window-multiplying unit 57 performs window-multiplying processing for the waveform data, based on a window function table, such as Hanning (hann/Humming) window, Black man window, stored in a window table 58, along with the progress of the current address output by the current address counter 53, and outputs the window-multiplying processed waveform data as an exciting signal to the gate amplifiers 35A to 35C.

Figure 7:
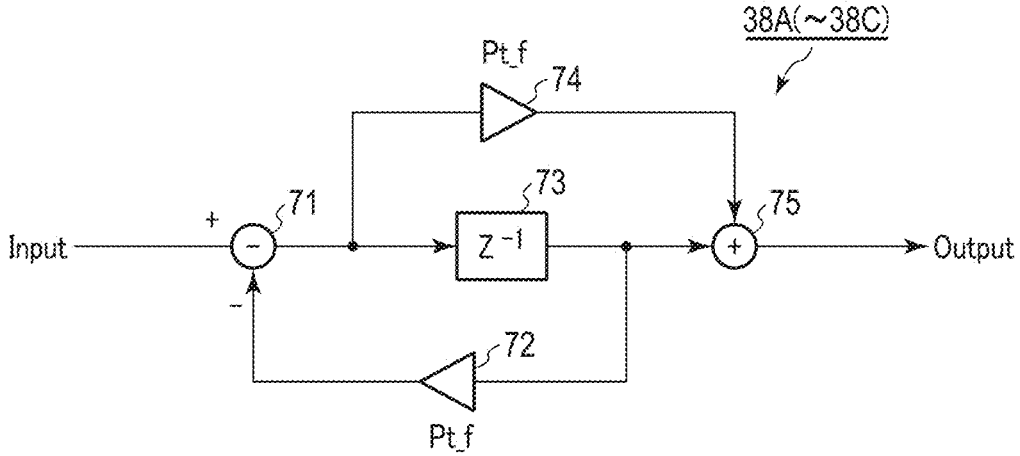
FIG. 7 is a block diagram showing the circuit configuration of an all-pass filter according to the embodiment.

FIG. 7 is a block diagram showing a detailed circuit configuration of the all-pass filter 38A (to 38C). The output from the delay circuit 37A in the previous step is input in a subtractor 71. The subtractor 71 performs subtraction using the waveform data a sampling cycle earlier, output by an amplifier 72, as a subtrahend, and outputs waveform data as the difference to a delay retainer 73 and an amplifier 74. The amplifier 74 outputs waveform data attenuated according to a string length delay Pt_f to an adder 75.

The delay retainer 73 retains the sent data, delays it by a sampling cycle (Z−1), and outputs it to the amplifier 72 and the adder 75. The amplifier 72 outputs the waveform data attenuated according to the string length delay Pt_f to the subtractor 71 as a subtrahend. The sum output of the adder 75 is sent to the low-pass filter 39A (to 39C) in the subsequent step as waveform data delayed by only a time determined in accordance with the input note number information (pitch data) (the time for a single wavelength), in conjunction with the delaying operation of the delay circuit 37A (to 37C) in the previous step.

Figure 8:
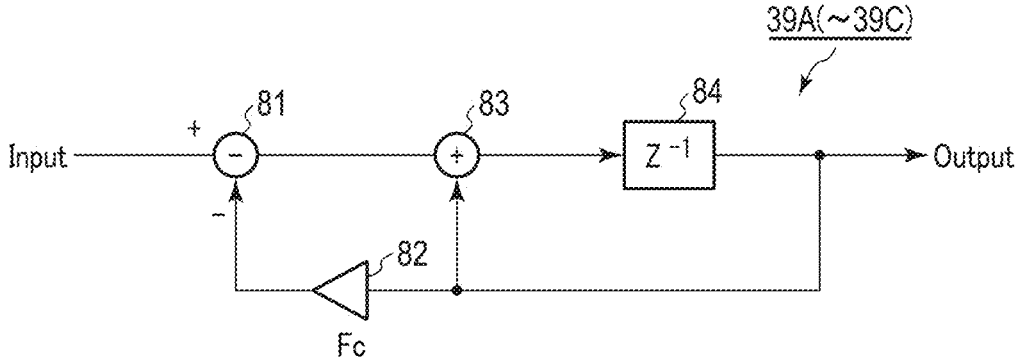
FIG. 8 is a block diagram showing the circuit configuration of a low-pass filter according to the embodiment.

FIG. 8 is a block diagram showing a detailed circuit configuration of the low-pass filter 39A (to 39C). The delayed waveform data from the all-pass filter 38A (to 38C) in the previous step is input in a subtractor 81. The subtractor 81 is given waveform data of a cutoff-frequency Fc or higher, output by an amplifier 82, as a subtrahend, and as the difference, waveform data on the low-frequency side less than the cut-off frequency Fc is calculated and output to an adder 83.

Identical waveform data a sampling cycle earlier, output by a delay retainer 84, is input together in the adder 83, and waveform data as the sum is output to the delay retainer 84. The delay retainer 84 retains the data sent from the adder 83, delays it by a sampling cycle (Z−1), and outputs it as output of this low-pass filter 39A and also to the amplifier 82 and the adder 83.

As a result, the low-pass filter 39A (to 39C) passes the waveform data on the low-frequency side by using a cut-off frequency Fc for high-frequency band attenuation set for the frequency of the string length, and outputs the waveform data to an attenuation amplifier 40A and a delay retainer 45A in the subsequent step.

[Operation]

Next, the operation of the embodiment will be described.

First, waveform data to be stored in the waveform memory 34 (ROM12B) will be described.

Figure 9:
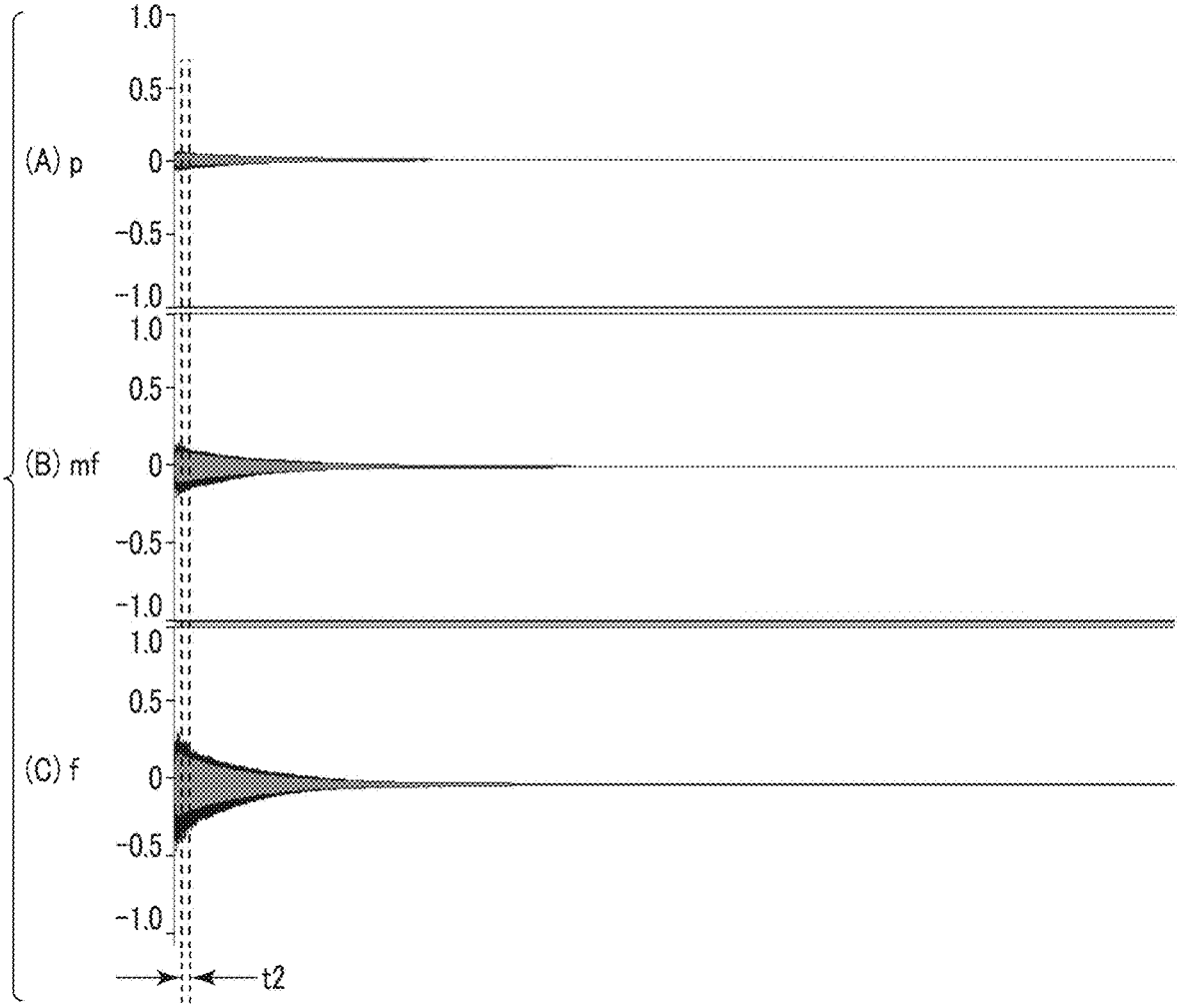
FIG. 9 is a diagram illustrating recorded and collected musical sound waveforms according to the embodiment, which are different in sound intensity (velocity value) in a certain key.

FIG. 9 is a diagram illustrating waveforms of recorded and collected musical sound having the same note number and different velocity values. FIG. 9 (A) shows a waveform of a piano (p), FIG. 9 (B) shows a waveform of mezzo forte (mf), and FIG. 9 (C) shows a waveform of forte (f). In the modeling, it is desired to use only a portion which is close to the first portion of each waveform and a harmonic tone configuration is stabilized after an impact (t2-interval in the figure).

It is also desired to perform, as preprocessing, normalization processing for a plurality of these pieces of recorded data so as to have an equal amplification.

FIG. 10 is a diagram illustrating a method of generating, in a pitch corresponding to a certain note number, an excitation signal from an addition synthesis of a strong-and-weak waveform. Data of a leading portion of the waveform data corresponding to the intensity of musical sound (strong-and-weak musical sounds) is added using each value shown by the addition rates in the figure, so that each of the musical sound intensities is changed along a temporal sequence similar to the progress of a stored address.

Specifically, FIG. 10 (A) shows waveform data of forte (f) which is high in intensity (i.e., sound intensity is high) for about six cycles. An addition rate signal for making the waveform data for about the first two cycles effective is given to this waveform data, as shown in FIG. 10 (B). Therefore, in a multiplying device (amplifier) 21, the waveform data is subjected to multiplication processing using, as a multiplier (amplification factor), the addition rate signal which varies between "1.0" to "0.0". This subjects the waveform data to multiplication processing, and waveform data as a product is output to an adder 24.

Similarly, FIG. 10 (C) shows waveform data of mezzo forte (mf) for about 6 cycles, which is second waveform data in which the intensity is moderate (i.e., sound intensity is slightly strong). An addition rate signal for making waveform data for about two cycles in the middle effective is given to this waveform data, as shown in FIG. 10 (D). Therefore, a multiplying device 22 performs multiplying processing of waveform data using the addition rate signal as a multiplier and outputs waveform data as a product to the adder 24.

Similarly, FIG. 10 (E) shows waveform data piano (p) for about six cycles. This is third waveform data in which the intensity is low (strength of sound is weak). An addition rate signal for making waveform data for the two cycles in the last portion effective is given to this waveform data, as shown in FIG. 10 (F). Therefore, the multiplier 23 performs multiplying processing of waveform data using the addition rate signal as a multiplier, and outputs waveform data as a product to the adder 24.

Therefore, an output of the adder 24 which adds these waveform data sequentially changes in waveform from "strong" to "moderate" to "weak" for every two cycles, as shown in FIG. 10 (G).

Such waveform data (excitation signal waveform data) is preliminarily stored in the waveform memory 34, and a start address according to the intensity of playing (music performance) is designated, thereby ensuring that necessary waveform data (partial data) is read as an excitation signal. The read waveform data is subjected to window-multiplying processing by a window-multiplying processing unit 33 as shown in FIG. 10 (H), and supplied to respective signal circulation circuits in the subsequent step.

Since waveform data for a portion of two to three wavelengths is used, the numbers of pieces sampling data constituting the waveform data differ depending on the pitch. For example, in the case of 88 keys of an acoustic piano, the number of pieces of sampling data from low pitch sound (low note) to high pitch sound (high note) is approximately 2000 to 20 or so (in the case of sampling frequency: 44.1 [kHz]).

The addition method of waveform data is not limited to combinations of waveform data which differ in the intensity of playing (music performance) of only the same musical instrument. For example, in the case of an electric piano, although when keys are touched weakly the resulting waveform data has waveform characteristics close to those of a sinusoidal wave, when the keys are touched strongly the resulting waveform data has a waveform akin to a saturated rectangular wave. It is possible to generate musical sound in a model which sequentially changes sound, by means of the intensity of playing or other playing operators, by sequentially adding various different musical sounds of a musical instrument, such as these waveforms apparently different in shape, e.g., waveforms extracted from a guitar.

Figure 11:
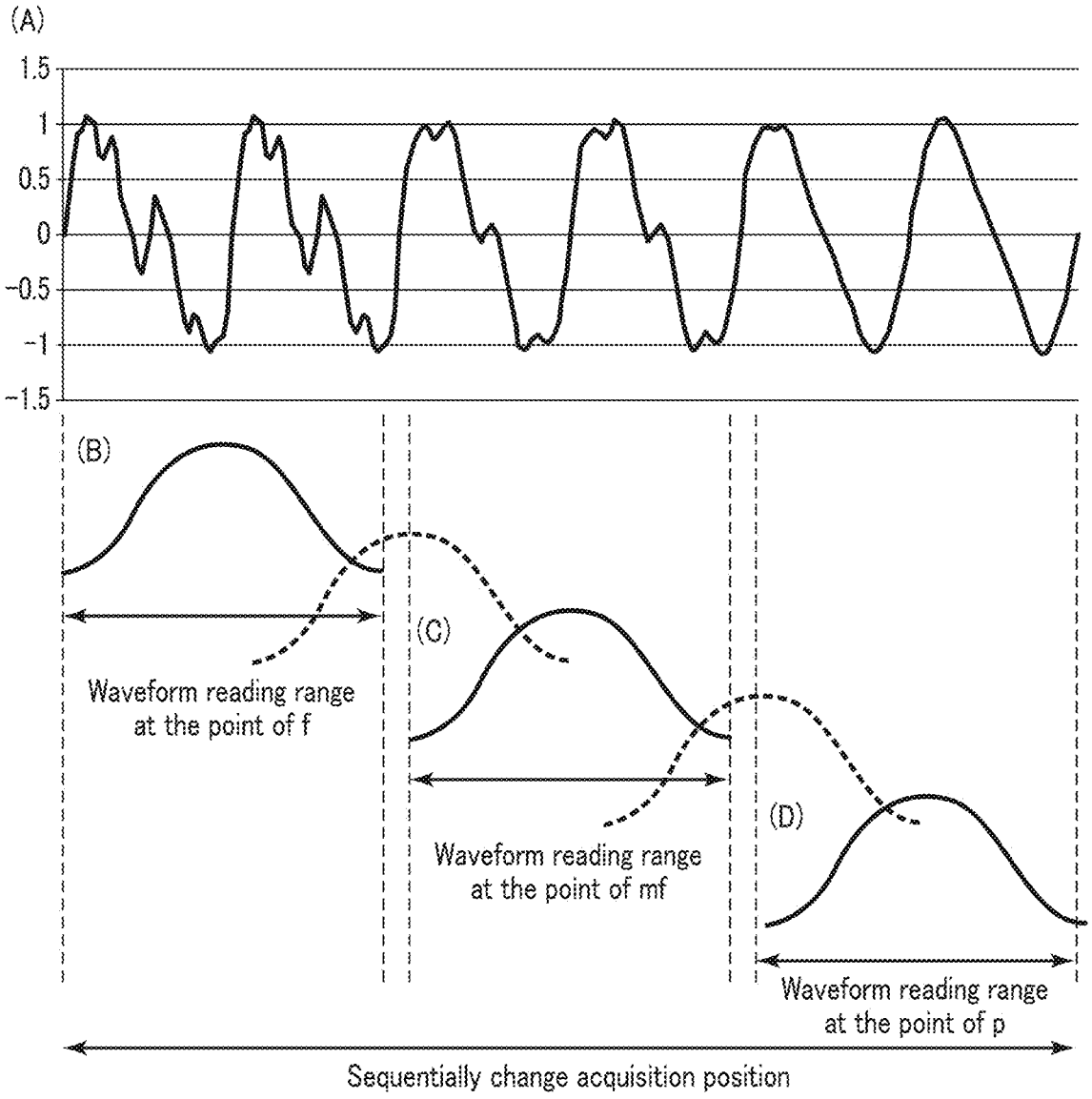
FIG. 11 is a diagram illustrating the process of changing a read address of a waveform memory in accordance with a velocity value, according to the embodiment.

FIG. 11 illustrates a process in which when the sound source 12D is driven, the waveform reading unit 32 changes a read address of the waveform memory 34 in accordance with a velocity value. As shown in FIG. 11 (A), such waveform data that is sequentially changing from forte (f) to piano (p) is preliminarily stored in the waveform memory 34, and a read-start address is changed to read out a waveform data portion according to the velocity value during playing.

FIG. 11 (B) shows a read range of waveform data when the velocity value corresponds to forte (f); FIG. 10 (C) shows a read range of waveform data when the velocity value corresponds to mezzo-forte (mf); and FIG. 10 (D) shows a read range of waveform data when the velocity value corresponds to piano (p).

Actually, the number of steps is not limited to the three steps described above, as shown by a dotted line in a window-multiplying waveform in the figure; for example, when the resolution of the velocity value is 7 bits, the number of steps is divided into 128 steps, and the read-out position of waveform data using the note number is sequentially changed.

When subjecting the read waveform data to window-multiplying processing, the wavelength differs depending on the tone interval, and therefore, it is necessary to also make the time length for the portion subjected to the window-multiplying processing different.

Figure 12:
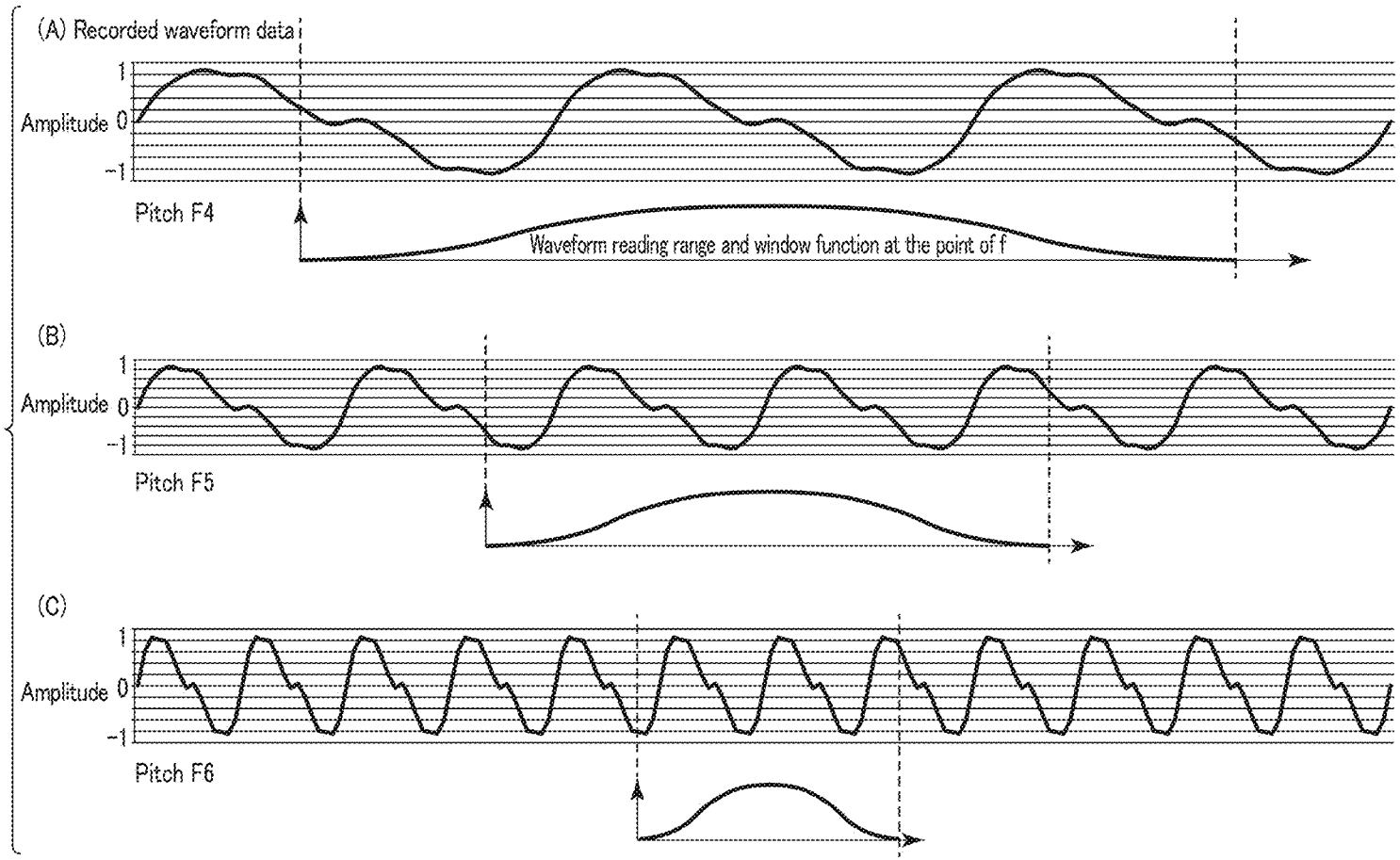
FIG. 12 is a diagram illustrating the relationship of a window function in accordance with a wavelength (pitch), according to the embodiment.

FIG. 12 is a diagram illustrating the relationship of a window function according to a waveform (pitch). FIG. 12 (A) shows a waveform read range and a window function for waveform data of forte (f) in the case of a pitch F4 (MIDI: 65). Similarly, FIG. 12 (B) shows a waveform read range and a window function for waveform data in the case of a pitch (F5 (MIDI: 77) which is one-octave higher than the waveform data shown in FIG. 12 (A), and FIG. 12 (C) shows waveform data in the case of a pitch (F6 (MIDI: 89) which is a further one-octave higher than the waveform data shown in FIG. 12 (B).

As shown in each of the figures, when a result of subjecting waveform data stored in the waveform memory 34 to window-multiplying processing is used as an excitation signal, the time width of a waveform differs depending on a pitch according to a designated note number, and therefore, it is also necessary to change the size (time width) with which the window-multiplying is performed in accordance with the a designated note number.

In addition to subjecting the waveform data read from the waveform memory 34 by the waveform reading unit 32 to the window-multiplying processing through the window-multiplying processing unit 33 as described above, it is assumed that the waveform data itself stored in the waveform memory 34 has been preliminarily subjected to the window-multiplying processing, and unnecessary frequency components have been removed therefrom.

For a window function used herein for the waveform data to be stored, a function which has less influence on overtone components of original sound of musical sound, such as a Hanning (hann/Hamming) window, a Blackman window, and a Kaiser window, is sufficient.

The waveform data which is read from the waveform memory 34 by the waveform reading unit 32 and subjected to the window-multiplying processing by the window-multiplying processing unit 33 is processed using a multiplier according to an operated velocity value through the gate amplifiers 35A to 35C, and then input in a signal circulation circuit constituting the string model.

A single string model is composed of a closed-loop including a delay circuit 37A (to 37C) which generates delay for a waveform portion of musical sound to be generated, and the inside of the loop includes an all-pass filter 38A (to 38C), a low-pass filter 39A (to 39C), an attenuation amplifier 40A (to 40C), a delay retainer 45A (to 45C) which returns and input waveform data of resonance sound of an all-string model of other pitches, a subtractor 46A (to 46C), an attenuation amplifier 47A (to 47C), an adder 41A (to 41C) which adds them, and the adder 36A (to 36C) which adds excitation signals of signals of the model.

In relation to the matter that the delay circuit 37A (to 37C) and the all-pass filter 38A (to 38C) delay a value in which an inverse number of a dismal part of a pitch frequency of musical sound to be generated and an integer 1 are added by means of digital processing to the delay circuits 37A (to 37C), while an integer part of the wavelength is given as a string delay Pt0_*r* [n] (to Pt2_*r* [n]), a decimal part of the wavelength is given as a string delay Pt0_*f* [n] (to Pt2_*f* [n]) to the all-pass filter 38A (to 38C).

As described above, FIG. 4 shows a configuration of a circuit corresponding to key positions of medium registers to higher registers, provided with a string model in which three strings are provided for a single key in conformity to an acoustic piano.

In the case of an acoustic piano, the degree of adjustment of pitches of these three strings of this model is referred to as "unison", and it is set to pitches minutely different from one another. These different pitches are parameters adjusted depending on a piano to be modeled.

A cut-off frequency Fc [n] to the low-pass filter 39A (to 39C) which adjusts the time from pronunciation (sound emission), as well as the attenuation of overtone components, is also set in accordance with a piano and strings to be modeled, similarly.

An output of each string model is added by the adder 43, outputs for 88 keys are further added to the output by an adder 44, and the resulting data is output to the D/A converting unit 12E in the subsequent step, and is input as negative feedback, through the delay retainer 48 and the reversal amplifier 49 as waveform data of resonance sound.

Waveform data which becomes a signal exciting the string model of a closed-loop is read out from the waveform memory 34 by the waveform reading unit 32 and subjected to window-multiplying processing by the window-multiplying processing unit 33, and then, in the gate amplifiers 35A to 35C. The processed signal is multiplied by a multiplier according to the velocity value, and supplied to respective signal circulation circuits constituting the string model.

At the point of note-on (key-pressing), a signal is sent from the note event processing unit 31 to the envelope generator 42, and a resonance value calculated from the output of the envelope generator 42 and a resonance level is given to the attenuation amplifier 47A (to 47C) as a multiplier (amplification factor).

The output of the low-pass filter 39A (to 39C) as the output of a delay system of each string model is sent directly to the attenuation amplifier 40A (to 40C), delayed by the delay retainer 45A (to 45C) by a sampling cycle, and then subtracted by the subtractor 46A (to 46 C), as a subtrahend, from waveform data of negative feedback resonance sound on which waveform data of all string models of pitches generated at that time point is superimposed. Therefore, the waveform data output by the subtractor 46A is obtained by removing components of the string model from the resonance sound. After the waveform data is subjected to attenuation in accordance with the resonance value by the attenuation amplifier 47A (to 47C), the waveform data is added to the waveform data of the self-string model by the adder 41A (to 41C), and the sum output is a feedback input of the close loop.

In this way, the waveform data of the resonance sound from which the components of the self-string model are removed beforehand and the waveform data of the string model are added together to be the feedback input of the close loop circuit, and thus anomalous oscillation due to resonance sound can be suppressed.

In response to the occurrence of note-off (upon receipt of instructions for weakening sound including sound deadening) at the point of key-release, the envelope generator 42 outputs a signal of a resonance value according to a sound volume of a stage of R (Release) so that an attenuation coefficient is adjusted by the attenuation amplifier 47A as a multiplying device for attenuation for resonance sound furnished inside the closed-loop.

At this time, when a note-on signal is lost, the waveform data for an excitation signal newly read by the waveform reading unit 32 is cut off by the gate amplifiers 35A to 35C and is not input in the close loop circuit anymore, and thus each string model naturally perform sound deadening processing also on a musical sound signal and resonance sound to be generated, in accordance with a set attenuation coefficient

Advantageous Effect of the Embodiment

According to the present embodiments as described above in detail, it becomes possible to generate resonance sound while suppressing anomalous oscillation without increasing the circuit scale.

In the present embodiment, in accordance with a note-on signal output by the note event processing unit 31 according to an operation of a key, it is also possible to generate a musical sound signal of a string model of the corresponding key, in addition to resonance sound, and thus the configuration and the control of the circuit can be simplified.

Furthermore, the present embodiment is configured such that the attenuation of resonance sound is controlled using a signal for controlling a temporal change in a sound volume of musical sound, output by the envelope generator 42, and thus it is possible to perform very natural attenuation processing while relatively simplifying the configuration for generating resonance sound.

In addition, the present embodiment is configured such that waveform data which becomes an excitation signal is subjected to window-multiplying processing using a window function and then input in a close loop circuit, and thus it is possible to effectively perform handling when waveform data is repeatedly subjected to calculation processing together with waveform data of resonance sound in a close loop circuit.

As described above, the present embodiment describes a case where the embodiment applies to an electronic keyboard instrument; however, the present invention is not limited to a particular instrument or a particular model.

The invention of the present application is not limited to the embodiment described above, and can be modified variously modified in the implementation stage without departing from the scope of the invention. In addition, the embodiments may be suitably implemented in combination, in which case a combined effect is obtained. Furthermore, inventions in various stages are included in the above-described embodiments, and various inventions can be extracted by a combination selected from a plurality of the disclosed configuration requirements. For example, even if some configuration requirements are removed from all of the configuration requirements shown in the embodiments, if the problem described in the column of the background of the invention can be solved, and an effect is obtained, a configuration from which this configuration requirement is removed can be extracted as an invention.

What is claimed is:

1. An electronic musical instrument comprising:

a plurality of operators which includes a first operator corresponding to a first pitch and a second operator corresponding to a second pitch; and a sound source, wherein the sound source is configured to:

generate, in response to designation of the first operator and the second operator, a first output signal from a first close loop corresponding to the first pitch and a second output signal from a second close loop corresponding to the second pitch;

generate an integration signal by integrating the first output signal and the second output signal;

subtract a signal circulating through the first close loop from the integration signal to obtain a subtraction signal; and return the subtraction signal to the first close loop, and then output a musical sound signal including signal component corresponding to the second pitch as a musical sound signal corresponding to the first pitch.

2. The electronic musical instrument according to claim 1, wherein the sound source is configured to:

invert a polarity of a signal resulting from integration of the first output signal from the first close loop and the second output signal from the second close loop, to generate the integration signal.

3. The electronic musical instrument according to claim 1, wherein the sound source is configured, in response to designation of the first operator and the second operator, to:

add, to the first close loop through which an excitation signal corresponding to the first pitch is circulated, a signal based on the second output signal from the second close loop through which an excitation signal corresponding to the second pitch is circulated, to generate a musical sound signal corresponding to the first pitch and including a signal component corresponding to the second pitch, and add, to the second close loop, a signal based on the first output signal from the first close loop, to generate a musical sound signal corresponding to the second pitch and including a signal component corresponding to the first pitch.

4. The electronic musical instrument according to claim 3, wherein the excitation signal is generated by, for a corresponding pitch, multiplying partial data contained in excitation signal waveform data, which is generated based on a plurality of waveform data items having sound intensities different from one another, by a window function.

5. The electronic musical instrument according to claim 3, wherein wherein the sound source is configured to:

read out, in response to input of playing operation data comprising pitch data and sound volume data, from excitation signal waveform data according to a pitch indicated by the pitch data in the input playing operation data, partial data according to the sound volume data in the input playing operation data, and multiplying the read partial data by a window function to generate the excitation signal.

6. The electronic musical instrument according to claim 5, wherein the read partial data has a number that differs according to the pitch indicated by the pitch data, and a width of a window of the window function also differs according to the pitch indicated by the pitch data.

7. The electronic musical instrument according to claim 1, wherein the subtraction signal is returned to a close loop corresponding to a pitch being pronounced and not returned to a close loop corresponding to a pitch not being pronounced.

8. A method comprising:

generating, in response to designation of a first operator and a second operator, a first output signal from a first close loop corresponding to a first pitch and a second output signal from a second close loop corresponding to a second pitch;

generating an integration signal by integrating the first output signal and the second output signal;

subtracting a signal circulating through the first close loop from the integration signal to obtain a subtraction signal; and returning the subtraction signal to the first close loop, and then outputting a musical sound signal including signal components corresponding to the second pitch as a musical sound signal corresponding to the first pitch.

9. The method according to claim 8, further comprising:

causing the electronic musical instrument to:

invert a polarity of a signal resulting from integration of the first output signal from the first close loop and the second output signal from the second close loop, to generate the integration signal.

10. The method according to claim 9, further comprising:

causing the electronic musical instrument, in response to designation of the first operator and the second operator, to:

add, to the first close loop through which an excitation signal corresponding to the first pitch is circulated, a signal based on the second output signal from the second close loop through which an excitation signal corresponding to the second pitch is circulated, to generate a musical sound signal corresponding to the first pitch and including a signal component corresponding to the second pitch, and add, to the second close loop, a signal based on the first output signal from the first close loop, to generate a musical sound signal corresponding to the second pitch and including a signal component corresponding to the first pitch.

11. The method according to claim 10, further comprising:

causing the electronic musical instrument to:

read out, in response to input of playing operation data comprising pitch data and sound volume data, from excitation signal waveform data according to a pitch indicated by the pitch data in the input playing operation data, partial data according to the sound volume data in the input playing operation data, and multiply the read partial data by a window function to generate the excitation signal.

12. The method according to claim 8, further comprising:

causing the electronic musical instrument to:

return the subtraction signal to a close loop corresponding to a pitch being pronounced and not to return the subtraction signal to a close loop corresponding to a pitch not being pronounced.

13. A non-transitory computer-readable storage medium having a program stored thereon which controls a computer of an electronic musical instrument to perform functions comprising:

causing an electronic musical instrument to:

generate, in response to designation of a first operator and a second operator, a first output signal from a first close loop corresponding to a first pitch and a second output signal from a second close loop corresponding to a second pitch, generate an integration signal by integrating the first output signal and the second output signal;

subtract a signal circulating through the first close loop from the integration signal to obtain a subtraction signal; and return the subtraction signal to the first close loop, and then output a musical sound signal including signal components corresponding to the second pitch as a musical sound signal corresponding to the first pitch.

* * * * *